US007296311B1

(12) United States Patent
Navarrette

(10) Patent No.: US 7,296,311 B1
(45) Date of Patent: Nov. 20, 2007

(54) MATTRESS SUPPORTED FRAME AND TRAY

(76) Inventor: Philip F. Navarrette, 12339 Dorland #A, Whittier, CA (US) 90601

( * ) Notice: Subject to any disclaimer, the term of this patent is extended or adjusted under 35 U.S.C. 154(b) by 0 days.

(21) Appl. No.: 11/478,764

(22) Filed: Jun. 30, 2006

(51) Int. Cl.
*A47B 23/00* (2006.01)

(52) U.S. Cl. ..... 5/507.1; 5/659; 108/49

(58) Field of Classification Search ..... 5/503.1, 5/507.1, 659, 426, 658; 108/49
See application file for complete search history.

(56) References Cited

U.S. PATENT DOCUMENTS 3,698,328 A 10/1972 Weir
3,894,709 A 7/1975 Weir
4,404,698 A * 9/1983 Koncelik et al. ..... 5/507.1
4,465,255 A 8/1984 Hill
4,819,568 A 4/1989 Coffrin
5,009,379 A * 4/1991 Sadler ..... 248/174
5,038,434 A 8/1991 Navarrette
5,359,741 A 11/1994 Lang
5,642,541 A 7/1997 Corbin
6,742,204 B1 * 6/2004 Barker ..... 5/507.1
6,834,403 B1 * 12/2004 Elliott ..... 5/505.1

* cited by examiner

*Primary Examiner*—Michael Trettel
(74) *Attorney, Agent, or Firm*—Kenneth L. Green; Edgar W. Averill, Jr.

(57) ABSTRACT

A tray is supported by a tubular frame residing between a mattress and box spring. The frame is a single continuous loop of tubing having a substantially horizontally residing supported portion, a vertical center portion, and a substantially horizontal tray support portion. The tray is rectangular with a raised edge and includes clips residing on a tray bottom to snap onto the frame.

11 Claims, 3 Drawing Sheets

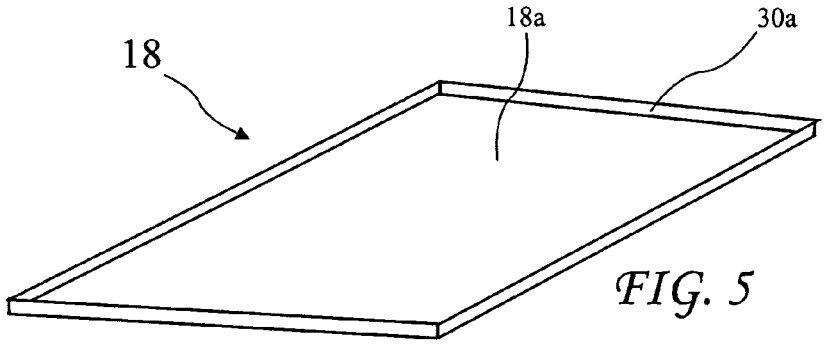
FIG. 5
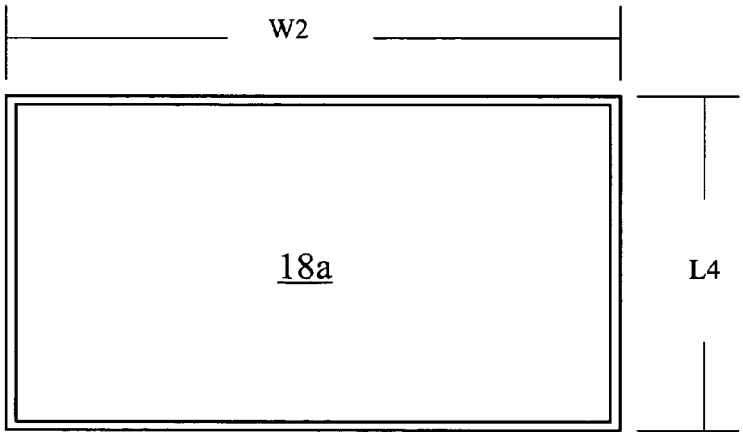
FIG. 6C
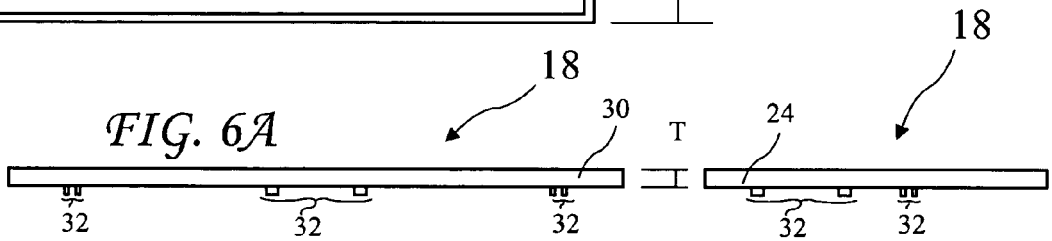
FIG. 6A
FIG. 6B
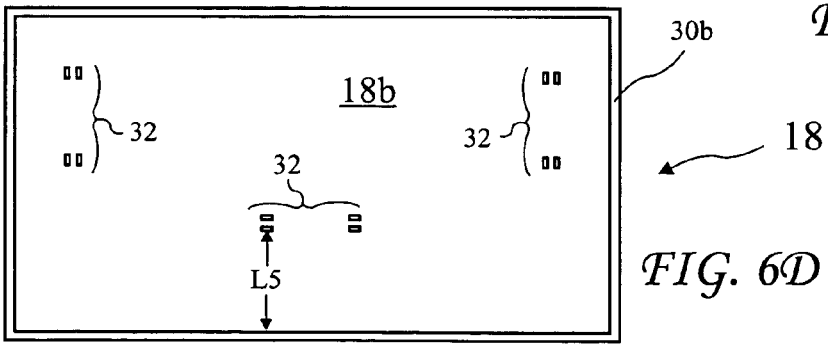
FIG. 6D
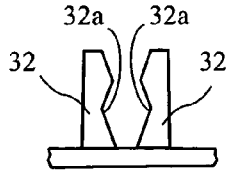
FIG. 7

MATTRESS SUPPORTED FRAME AND TRAY

BACKGROUND OF THE INVENTION

The present invention relates to a support frame and tray and in particular to a mattress supported tubular support frame and snap-on tray.

There is often a need for a tray adjacent to a bed to hold various articles such as books, lamps, food, drinks, and the like. One solution is a tray with legs which support the tray above the floor. Unfortunately, such floor supported trays are often cumbersome and easily knocked over. Other solutions comprise trays supported by a frame residing between a mattress and box spring. Such frames generally comprise a flat plate residing horizontally when in use, and vertical members rising from the flat plate to support the tray. Unfortunately, such flat plates may slip between the mattress and box spring, and comprise several members raising production costs. Therefore, a need remains for a simple and stable mattress supported frame and tray.

BRIEF SUMMARY OF THE INVENTION

The present invention addresses the above and other needs by providing a tray supported by a tubular frame residing between a mattress and box spring. The frame is a single continuous loop of tubing having a substantially horizontally residing supported portion, a vertical center portion, and a substantially horizontal tray support portion. The tray is rectangular with a raised edge and includes clips residing on a tray bottom to snap onto the frame.

In accordance with one aspect of the invention, there is provided a mattress supported frame and tray. The frame is a substantially round tubular frame having a supported portion, a center portion, and a tray support portion. The supported portion is substantially planar (i.e., may include some vertical variation, but not enough to affect the mattress) and has an inward end insertable under a mattress and an outward end opposite the inward end. The center portion is approximately orthogonal to the supported portion and has a lower end extending vertically from the outward end of the supported portion and a higher end opposite the lower end. The tray support portion is approximately parallel to the supported portion and extends horizontally from the higher end of the center portion, extending opposite the supported portion. The tray includes pairs of downwardly extending opposed clips configured to grasp the frame.

In accordance with another aspect of the invention, there is provided a mattress supported frame and tray having a continuous tube frame.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 5 is a detailed perspective view of the tray.

FIG. 6A is a front view of the tray.

FIG. 6B is a side view of the tray.

FIG. 6C is a top view of the tray.

FIG. 6D is a bottom view of the tray.

FIG. 7 show fingers with concave inner opposing surfaces.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figures 1, 2:
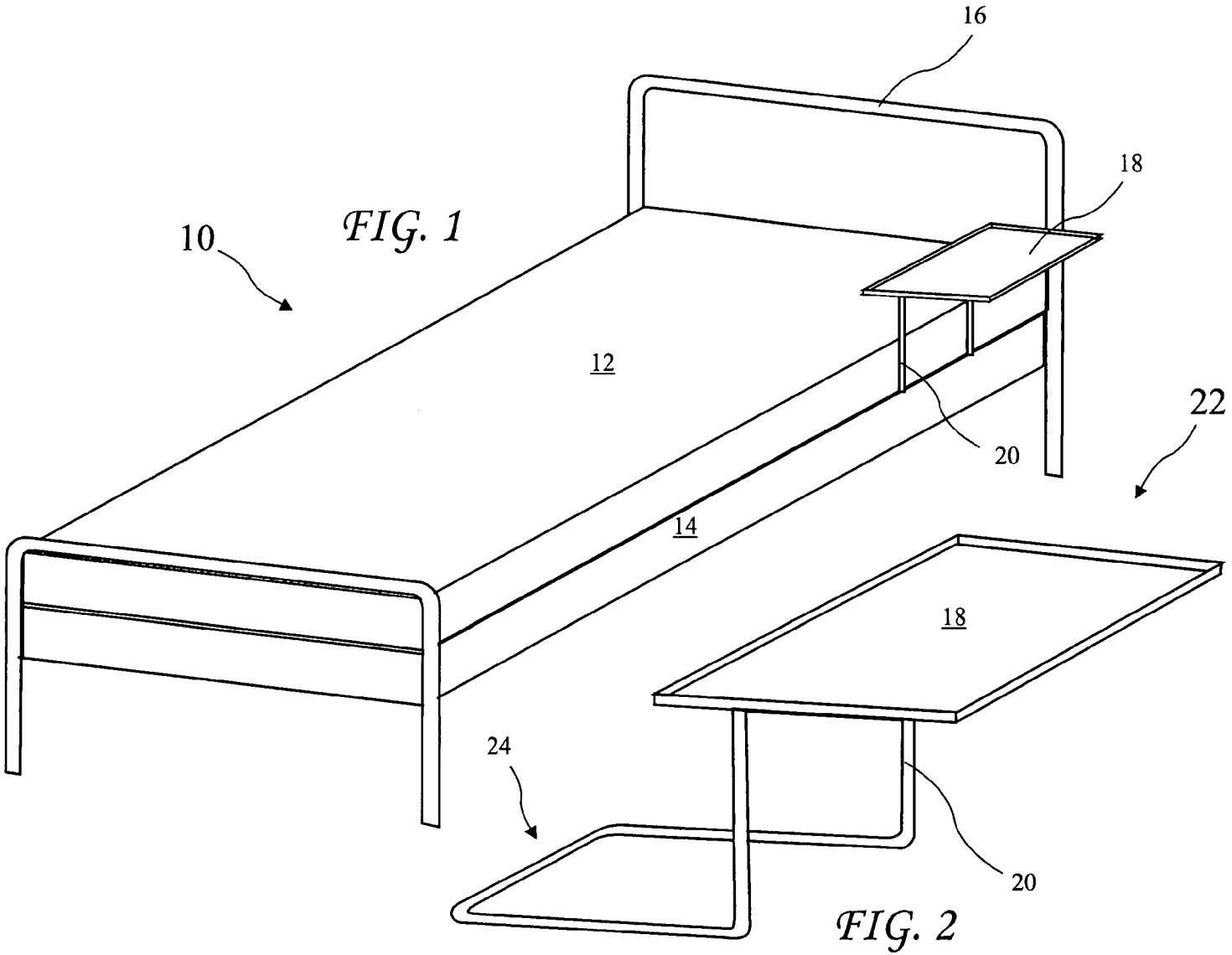
FIG. 1 is a perspective view of a bed with a mattress supportable frame and tray according to the present invention.
FIG. 2 is detailed perspective view of the mattress supportable frame and tray alone.

A perspective view of a bed 10 with a mattress supportable frame and tray 22 according to the present invention is shown in FIG. 1. The bed includes a bed frame 16 supporting a mattress 12 and usually a box spring 14. A frame 20 of the frame and tray 22 is inserted between the mattress 12 and the box spring 14 to support and secure the frame 20. A tray 18 is attached to the frame 20 for convenient use.

A detailed perspective view of the mattress supportable frame and tray 22 is shown in FIG. 2, The frame includes a supported portion 24 which is inserted between the mattress 12 and the box spring 14.

Figure 3:
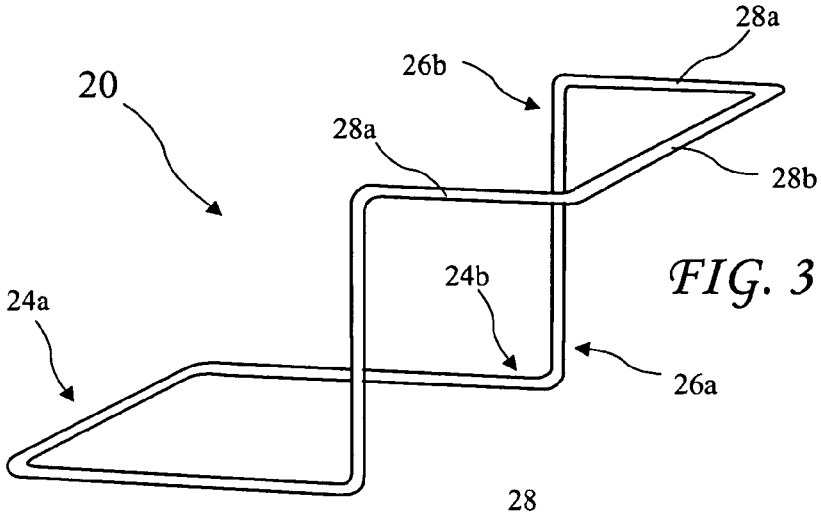
FIG. 3 is a detailed perspective view of the frame.
Figure 4C:
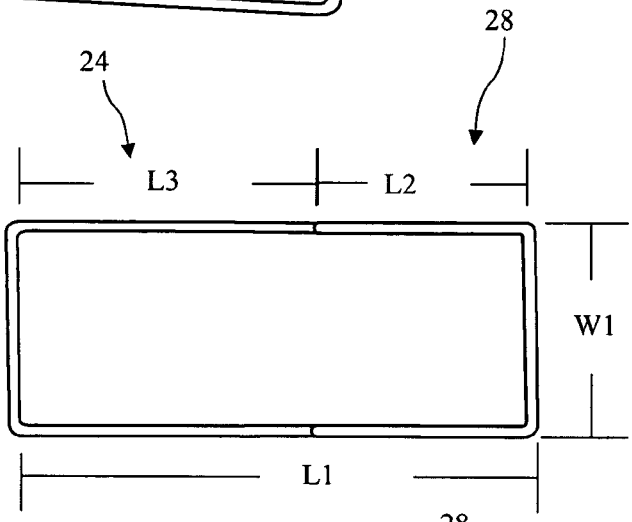
FIG. 4C is a top view of the frame.
Figure 4A:
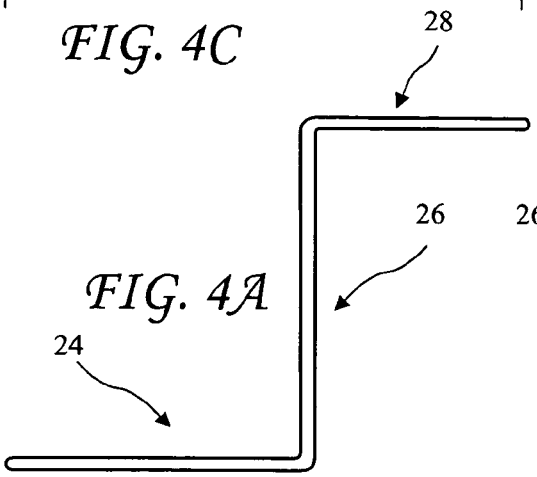
FIG. 4A is a side view of the frame.
Figure 4B:
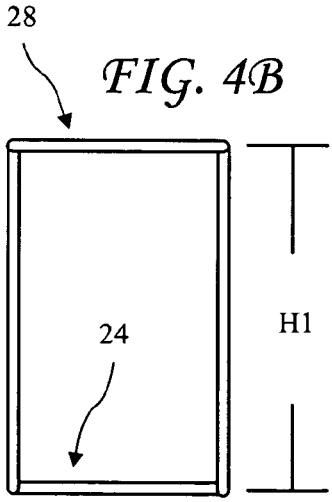
FIG. 4B is a front view of the frame.

A detailed perspective view of the frame 20 is shown in FIG. 3, a side view of the frame 20 is shown in FIG. 4A, a front view of the frame 20 is shown in FIG. 4B, and a top view of the frame is shown in FIG. 4C. The frame 20 includes a substantially planar supported portion 24, a center portion 26, and a tray support portion 28. The supported portion 24 has an inward end 24*a* insertable under the mattress 12 and an outward end 24*b* opposite the inward end 24*a*. The center portion 26 is preferably approximately orthogonal to the supported portion 24 and has a lower end 26*a* extending from the outward end 24*b* of the supported portion 24 and a higher end 26*b* opposite the lower end 26*a*. The center portion 26 is not necessarily orthogonal to the supported portion 24 but should have some vertical extent to raise the height of the tray 18 when in use. If the center portion 26 is sloped too much, the tray 18 may be displaced from the bed 10, however, in an alternative embodiment, a center portion may slope away from the bed 10, and the tray support portion 28 may be reversed and extend back towards the bed 10. The tray support portion 28 is approximately parallel to the supported portion 24 and extends from the higher end 26*b* of the center portion 26, extending opposite the supported portion 24. The tray support portion 28 comprises longitudinal portions 28*a* and a lateral portion 28*b* running between the longitudinal portions 28*a*, and the longitudinal portions 28*a* are preferably approximately parallel.

The frame 20 has a width W1 which is preferably between approximately ten inches and approximately fourteen inches, and more preferably approximately twelve inches. The frame 20 has a height H1 which is preferably between approximately ten inches and approximately eighteen inches, and more preferably between approximately twelve inches and approximately sixteen inches. The supported portion 24 has a length L3 of preferably between approximately ten inches and approximately sixteen inches, and more preferably between approximately twelve inches and approximately fourteen inches. The tray support portion 28 has a length L2 of preferably between approximately six inches and approximately ten inches, and more preferably approximately eight inches.

The frame 20 is preferably made from tubing and more preferably from round tubing. The frame 20 is also preferably a continuous loop and more preferably a continuous loop of tubing, for example, a continuous length of bent tubing, and most preferably joined at one or two points along the frame, and more preferably joined by welding at two points along the frame. The tubing preferably has an outside diameter between approximately ½ inches and ¾ inches and more preferably approximately ⅝ inches.

A detailed perspective view of the tray 18 is shown in FIG. 5, a front view of the tray 18 is shown in FIG. 6A, a side view of the tray 18 is shown in FIG. 6B, a top view of the tray 18 is shown in FIG. 6C, and a bottom view of the tray 18 is shown in FIG. 6D. The tray is approximately flat and has a top surface 18*a* which is preferably textured to reduce sliding. An edge 30 surrounds the tray 18 and provides stiffness. An upper edge portion 30*a* forms an edge around the top surface 18*a* to reduce the chance of items rolling or sliding off the tray top surface 18*a*. The edge 30 preferably includes a lower edge portion 30*b* extending downward to add stiffness.

Attaching features 32 for attaching the tray 20 to the frame 18 are shown in FIG. 7. The attaching features reside on the a tray bottom surface 18*b*. The attaching features 32 are preferably spaced apart opposing clips or fingers which the tray support portion 28 of the frame 18 snaps into. More preferably, attaching features 32 are pairs of downwardly extending fingers with concave inner opposing surfaces 32*a* to retain the tray 20 once snapped onto the frame 18. Most preferably, the attaching features 32 comprise three pairs of spaced apart pairs (a total of six pairs of fingers) of downwardly extending fingers which snap onto the longitudinal portions 28*a* and the lateral portion 28*b* of the tray support portion 28. Alternatively, the three pairs of spaced apart pairs of fingers may be replaced by 3 pairs of continuous clips, one pair of clips for each of the longitudinal portions 28*a* and one pair of clips for the lateral portion 28*b*. In another instance, the attaching features may be screws or similar fasteners passing though holes in the tray support portion and into the tray, or adhesives to attach the tray to the frame.

The tray 20 has a tray width W2, a tray length L4, and a tray thickness T. The tray length L4 is preferably approximately equal to the frame width W1 to facilitate packaging the frame and tray 20.

While the invention herein disclosed has been described by means of specific embodiments and applications thereof, numerous modifications and variations could be made thereto by those skilled in the art without departing from the scope of the invention set forth in the claims.

I claim:

1. A mattress supported frame and tray comprising:

a single continuous bent tube tubular frame having:

a tubular substantially planar supported portion having an inward end insertable under a mattress and an outward end opposite the inward end;

a tubular center portion approximately orthogonal to the supported portion and having a lower end extending from the outward end of the supported portion and a higher end opposite the lower end; and a tubular tray support portion approximately parallel to the supported portion and extending from the higher end of the center portion opposite the supported portion; and a tray configured to attach to the tray support portion of the frame.

2. The frame and tray of claim 1, wherein the tray has a bottom surface including clips which snap onto the tray support portion to attach the tray to the frame.

3. The frame and tray of claim 2, wherein the clips comprise opposing pairs of downward protruding fingers to grasp the frame.

4. The frame and tray of claim 3, wherein the opposing pairs of downward protruding fingers include concave inner opposing surfaces.

5. The frame and tray of claim 2, wherein;

the tray support portion comprises two longitudinal portions joined by a lateral portion; and the clips comprise six pairs of opposing downward protruding fingers arranged to grasp the two longitudinal portions and the lateral portion.

6. The frame and tray of claim 5, wherein the longitudinal portions are approximately parallel.

7. The frame and tray of claim 1, wherein the tray includes a tray edge to add stiffness to the tray.

8. The frame and tray of claim 7, wherein the tray edge includes a downward extending edge and an upward extending edge.

9. The frame and tray of claim 1, wherein the length of the tray is approximately equal to the width of the frame to facilitate packaging the frame and tray for shipping.

10. A mattress supported frame and tray comprising:

a continuous round tubular frame having:

a planar supported portion having an inward end insertable under a mattress and an outward end opposite the inward end;

a center portion approximately orthogonal to the supported portion and having a lower end extending from the outward end of the supported portion and a higher end opposite the lower end; and a tray support portion approximately parallel to the supported portion and extending from the higher end of the center portion opposite the supported portion; and a tray including pairs of downwardly extending opposed clips configured to grasp the frame.

11. A mattress supported frame and tray comprising:

a continuous tubular frame having:

a substantially planar supported portion having an inward end insertable under a mattress and an outward end opposite the inward end;

a center portion approximately orthogonal to the supported portion and having a lower end extending from the outward end of the supported portion and a higher end opposite the lower end; and a tray support portion approximately parallel to the supported portion and extending from the higher end of the center portion opposite the supported portion;

a tray configured to attach to the tray support portion of the frame; and three pairs of two pairs of opposing fingers having concave inner opposing surface and residing on a bottom surface of the tray for attaching the tray to the frame.

* * * * *